US011501962B1

(12) United States Patent
Quarmby et al.

(10) Patent No.: US 11,501,962 B1
(45) Date of Patent: Nov. 15, 2022

(54) DEVICE GEOMETRIES FOR CONTROLLING MASS SPECTROMETER PRESSURES

(71) Applicant: THERMO FINNIGAN LLC, San Jose, CA (US)

(72) Inventors: Scott T. Quarmby, Round Rock, TX (US); Joshua T. Maze, Round Rock, TX (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 17/350,905

(22) Filed: Jun. 17, 2021

(51) Int. Cl.
*H01J 49/06* (2006.01)
*H01J 49/00* (2006.01)
(Continued)

(52) U.S. Cl.
CPC ..... *H01J 49/067* (2013.01); *H01J 49/0068* (2013.01); *H01J 49/0481* (2013.01); *H01J 49/24* (2013.01); *H01J 49/4235* (2013.01)

(58) Field of Classification Search
CPC .. H01J 49/067; H01J 49/0068; H01J 49/0481; H01J 49/24; H01J 49/4235
(Continued)

(56) References Cited

U.S. PATENT DOCUMENTS 7,202,470 B1 4/2007 Marriott
7,426,848 B1 * 9/2008 Li ..... G01N 27/70 73/23.2

(Continued)

OTHER PUBLICATIONS

Johansson et al., "Combined high-pressure cell-ultrahigh vacuum system for fast testing of model metal alloy catalysts using scanning mass spectrometry", Review of Scientific Instruments, vol. 75 (6), pp. 2082-2093.

(Continued)

*Primary Examiner* — Nicole M Ippolito

(57) ABSTRACT

A mass spectrometer collision cell system, comprising: a gas containment vessel comprising an internal chamber having ion inlet and ion outlet ends and a cross-sectional area, $A_{chamber}$; a gas inlet aperture; first and second gas outlet apertures that are disposed at or proximal to the ion inlet and outlet ends, respectively, and that have respective outlet aperture cross-sectional areas, $A_{aperture1}$ and $A_{aperture2}$, and an average outlet aperture cross-sectional area, $A_{aperture}^{ave}$; a longitudinal axis of the chamber extending from the ion inlet end to the ion outlet end and having a length, $L_{chamber}$; and a set of multipole rod electrodes, at least a portion of each multipole rod electrode being within the chamber, wherein the values of $A_{chamber}$, $L_{chamber}$ and $A_{aperture}^{ave}$ are such that the combined gas conductance of the chamber and the gas outlet apertures is not greater than 95 percent of the gas conductance of the gas outlet apertures alone.

13 Claims, 11 Drawing Sheets

(51) Int. Cl.
*H01J 49/24* (2006.01)
*H01J 49/04* (2006.01)
*H01J 49/42* (2006.01)

(58) Field of Classification Search
USPC ..... 250/281, 282, 283, 290, 292
See application file for complete search history.

(56) References Cited

U.S. PATENT DOCUMENTS

| | | | | |
|---|---|---|---|---|
| 8,148,675 | B2 | 4/2012 | Okumura et al. | |
| 2004/0251411 | A1 | 12/2004 | Bateman et al. | |
| 2010/0148063 | A1 | 6/2010 | Schwartz et al. | |
| 2012/0205536 | A1 | 8/2012 | Itoi et al. | |
| 2022/0021290 | A1 * | 1/2022 | Mills ..... | H02K 44/10 |

OTHER PUBLICATIONS

Tanner et al., "Reaction cells and collision cells for ICP-MS: a tutorial review", Spectrochimica Acta Part B 57 (2002), 1361-1452.
Xia et al., "Evolution of Instrumentation for the Study of Gas-Phase lon/lon Chemistry via Mass Spectrometry", J Am Soc Mass Spectrom 2008, 19, pp. 173-189.

* cited by examiner

34b

DEVICE GEOMETRIES FOR CONTROLLING MASS SPECTROMETER PRESSURES

TECHNICAL FIELD

The present disclosure relates to mass spectrometry. More particularly, the present disclosure relates to geometries that affect pressure within components of mass spectrometers.

BACKGROUND

Mass spectrometry (MS) analysis techniques are generally carried out under conditions of high vacuum. For example, to work properly, some mass spectrometer components, such as mass analyzers, require high vacuum conditions in which gas pressure is maintained at a value of $10^{-6}$ Torr or lower. At the same time, ions that are to be analyzed are frequently generated at atmospheric pressure. Because of the large pressure difference between an ion source and a mass analyzer, mass spectrometer systems frequently comprise a plurality of evacuated chambers that are fluidically connected via small-aperture pumping restrictions and that are maintained at progressively lower pressure (i.e., higher vacuum) along the general ion pathway between the ion source and the mass analyzer. Moreover, the use of collision-induced-dissociation cells for the purpose of performing tandem mass spectrometry measurements requires a mass spectrometer configuration in which precursor ions are transported from a high vacuum environment ($10^{-5}$ Torr to $10^{-6}$ Torr) into an intermediate-vacuum environment (approximately $10^{-3}$ Torr) and in which fragment ions are transmitted from the intermediate-vacuum environment into another high-vacuum environment.

Relatedly, many mass spectrometer systems employ ion cooling cells in which ions having high kinetic energy are caused to collide, preferably without fragmentation, with molecules of a bath gas within the cooling cell. The ion/molecule collisions within an ion cooling cell cause a large proportion of the ions' initial kinetic energy to be absorbed by the gas and conducted away, thereby facilitating focusing and guiding of ions within downstream mass spectrometer components. The structure of an ion cooling cell is similar to that of a collision cell except that cooling cells lack any provision for imparting additional kinetic energy to ions prior to entering the cell or within the cell. Accordingly, fragmentation is minimized or eliminated. Accordingly, the efficient management of gas pressures and gas flow within mass spectrometer systems remains as a challenging problem As but one example of a mass spectrometer system that may employ a collision cell, FIG. 1A is a schematic illustration of a portion of an exemplary liquid chromatography mass spectrometry (LCMS) analysis system, shown generally at 10, that includes a conventional triple-quadrupole mass spectrometer. Referring to FIG. 1A, an ion source 12 housed in an ionization chamber 14 is configured to receive a liquid or gaseous sample from an associated apparatus such as for instance a liquid chromatograph or syringe pump through a capillary 37. As but one example, an atmospheric pressure electrospray source is illustrated. However, any ion source may be employed, such as a heated electrospray ionization (H-ESI) source, an atmospheric pressure chemical ionization (APCI) source, an atmospheric pressure matrix assisted laser desorption (MALDI) source, a photoionization source, or a source employing any other suitable ionization technique. The ion source 12 forms charged particles 39 (either ions or charged droplets that may be desolvated so as to release ions) representative of the sample, which charged particles are subsequently transported from the ion source 12 to the mass analyzer 36 in high-vacuum chamber 26 through one or more intermediate-vacuum chambers 18 and 25 of successively lower pressure in the direction of ion travel. In particular, the droplets or ions are entrained in a background gas and transported from the ion source 12 through an ion transfer tube 16 that passes through a first partition element or wall 15*a* into an intermediate-vacuum chamber 18 which is maintained at a lower pressure than the pressure of the ionization chamber 14 but at a higher pressure than the pressure of the high-vacuum chamber 26. The ion transfer tube 16 may be physically coupled to a heating element or block 23 that provides heat to the gas and entrained particles in the ion transfer tube so as to aid in desolvation of charged droplets so as to thereby release free ions.

A second plate or partition element or wall 15*b* may separate the intermediate-vacuum chamber 18 from a second intermediate-pressure region 25. Likewise, another plate or partition element or wall 15*c* separates an intermediate pressure region, i.e., region 25, from the high-vacuum chamber 26. An ion optical assembly 20*a* provides an electric field that guides and focuses the ion stream leaving ion transfer tube 16 through an aperture 22 in the second partition element or wall 15*b* that may be an aperture of a skimmer 21. A second ion optical assembly 20*b* may be provided so as to transfer or guide ions to an aperture 27 in the plate, partition element or wall 15*c*. Both the ion optical assembly 20*a* and the ion optical assembly 20*b* may be employed as ion cooling cells in which the initial kinetic energy of ions is damped by interaction with gas molecules which absorb the energy as heat. The ion cooling facilitates focusing of the ion pathways into a narrow, directed beam. Another ion optical assembly 20*c* may be provided in the high vacuum chamber 26 containing the mass analyzer 36. The ion optical assemblies or lenses 20*a*-20*c* may comprise transfer elements, such as, for instance multipole ion guides, so as to direct the ions through aperture 22 and into the mass analyzer 36. The mass analyzer 36 comprises a detector 40 whose output can be displayed as a mass spectrum. Vacuum ports, such as the illustrated vacuum ports 13, 17 and 19, may be used for evacuation of the various vacuum chambers.

FIG. 1B is a schematic illustration of a portion of an exemplary gas chromatography mass spectrometry (GCMS) analysis system 200 that employs a conventional triple-quadrupole mass spectrometer that may include a collision cell. The mass spectrometer components within the high-vacuum chamber 26 of the GCMS system 200 (FIG. 1B) may be similar or identical to the components within the LCMS system 10 (FIG. 1A). However, the GCMS system 200 does not employ an electrospray ion source and may instead use an Electron Ionization (EI) ion source, as shown generally at 203 in FIG. 1B.

The ion source 203 of the GCMS system 200 includes an ionization volume 210 into which sample molecules including analyte molecules are introduced via an outlet portion of a gas chromatograph (GC) column 235. The GC column 235 may be a fused silica capillary tube of a type well known in the art. Ionization volume 210 is located inside a vacuum chamber 210 that is evacuated, via vacuum port 17, to a suitable pressure by a not-illustrated pumping system. A stream of electrons is generated by passing a current provided by a filament current source 265 through thermionic filament 240. The filament current source 265 is located externally to the vacuum chamber and electrically connected to the filament 240 via a vacuum feed-through (not shown). Filament 240 is typically fabricated from a refractory metal such as rhenium or tungsten (or alloys thereof). The refractory metal may include a low work function coating such as thorium oxide or yttrium oxide. Electrons emitted by filament 240 travel, under the influence of an electrical field established by applying suitable potentials to the filament 240 and electrodes 250, through aperture 245 into the ionization volume 210 interior. The electron beam may also be guided by a magnetic field established by magnets (not shown) located behind and on the opposite side of ionization volume 210 from filament 240. The electrons interact with the sample molecules within ionization volume 210 to form sample ions. The sample ions are extracted from ionization volume 210 via ion exit aperture 255 by lenses 260, and are transported into the chamber 26, which contains the triple-quadrupole components, within which they are prepared for mass analysis and subsequently mass analyzed.

Other suitable ion sources may be used such as chemical ionization, inductively coupled plasma (ICP) ionization, secondary ion mass spectrometry, metastable atom bombardment, or photoionization. ICP-MS instruments may include a cell which can be used as a collision cell or reaction cell.

The illustrated triple-quadrupole mass spectrometer components within the LCMS system 10 (FIG. 1A) and the GCMS system 200 (FIG. 1B) comprise a first quadrupole device 32, a second quadrupole device 34 and a third quadrupole device 36, and an ion detector 40. In variant systems, one or more of the quadrupoles may be replaced by a non-quadrupole device. For example, the second quadrupole device 34 may be replaced by a general multipole device, such as an octupole device, a stacked ring ion guide, a non-RF device, etc. For illustration purposes, however, this device will continue to be referred to herein as a "second quadrupole device". In many modes of operation, the first quadrupole device is operated as a mass filter which is capable of transmitting only selected ions of a certain mass-to-charge ratio, m/z, while discarding other non-selected ions. The selected ions are then transported to the second quadrupole device 34. In many modes of operation, the second quadrupole device is employed as a fragmentation device which causes collision induced fragmentation of the selected precursor ions through interaction with molecules of an inert collision gas introduced through tube 35. When collision-induced fragmentation is not desired or is unnecessary, the second quadrupole device 34 may be operated as an RF-only device which transmits ions comprising a range of m/z values. Ions, either ions received from the ion source or else fragment ions generated within the second quadrupole device 34 are transmitted from the second quadrupole device 34 to the mass analyzer 36 for mass analysis.

For use as a device that fragments ions by collision induced dissociation, the second quadrupole device 34 comprises a gas containment vessel 38 that encloses an internal chamber that, in operation, retains collision gas therein. A set of quadrupole or other multipole rods 4 are also contained within the chamber. Precursor ions are introduced from the first quadrupole device 32 into the chamber of the containment vessel 38 through a first gas-flow-restricting aperture 6. Oscillatory radio-frequency (RF) voltage waveforms that are applied to the rods 4 by one or more power supplies (not shown) create a pseudopotential well that is centered about a longitudinal axis of the collision cell. This pseudopotential well confines the introduced ions precursor to the vicinity of the longitudinal axis.

When the second quadrupole device 34 is employed as a collision cell, the precursor ions that are introduced into the device 34 are caused to collide with the neutral molecules of collision gas within the internal chamber of the containment vessel 38. Fragment ions that are generated by the ion-molecule collisions are confined to the pseudopotential well that is centered about the longitudinal axis. After their generation, the fragment ions and any residual precursor ions exit the second quadrupole device 34 through a second gas-flow-restricting aperture 6 that faces the mass analyzer 36. Note that the term "aperture", as used herein, refers generally to a hole or opening, including an opening of or a channel through an ion lens as well as an opening of a section of a multipole device that restricts gas flow but that permits flow of a majority of ions. Generally, one or more electrostatic lenses are disposed at both ends (the inlet end and the outlet end) of the second quadrupole device 34 in order to control the entry of ions into and the exit of ions from the device. These electrostatic end lenses may also be employed to create an electric field within the chamber of the containment vessel that is parallel to the longitudinal axis and that urges ions through the chamber from the inlet to the outlet ends. Thus, the apertures 6 are generally not defined by holes or gaps in the containment vessel 38 but, instead, are defined as being coincident with the apertures of the electrostatic end lenses. Frequently, the diameters of the apertures of the electrostatic end lenses are restricted to certain pre-determined values based on ion guiding principles that are unrelated to the ion fragmentation process.

FIG. 2 is a schematic cross-sectional diagram of a known collision cell apparatus 34*a* that is used, in the position of quadrupole 34, to generate fragment ions by collision-induced fragmentation. The cross section shown in FIG. 2 is taken transverse to a longitudinal axis of the apparatus. In operation of the collision cell apparatus 34*a*, precursor ions are introduced into an internal chamber 53 that includes an inert gas or, alternatively, a reagent gas or reaction gas at a typical internal pressure of approximately 1-20 mTorr. The chamber 53 that is depicted in FIG. 2 has the geometric form of a right circular cylinder. Within the chamber, precursor ions collide with neutral gas molecules and are thereby caused to fragment or to otherwise react with the gas to form product ions. A set of quadrupole rods 54 are disposed within the chamber 53 and are elongated parallel to the longitudinal axis of the collision cell 34*a* that is perpendicular to the plane of the drawing. The four quadrupole rods 54 are separated from a housing 58 of the collision cell apparatus 34*a* by an insulative spacer layer 55 and receive RF-only voltage waveforms from a power supply (not shown). The applied RF-only voltage waveforms maintain precursor ions and fragment ions (or other product ions) having a range of m/z values within a pseudopotential well that is centered midway between the free ends of the four rods 54. The inert gas is provided into the chamber 53 through a gas inlet tube 35 (see FIGS. 1A, 1B and 7) that is not depicted in FIG. 2 but that passes through the housing 58 and the insulative spacer layer 55 within a transverse cross section other than the cross section shown in FIG. 2.

A set of drag vanes 51 are also disposed within the chamber 55 and are attached to the insulative spacer layer by mounting structures 57. Each drag vane is in the form of an elongated plate, the long dimension of which is parallel to the longitudinal axis of the collision cell 34*a*, i.e., perpendicular to the plane of the drawing. chamber 53. As described in U.S. Pat. No. 7,675,031, each drag vane comprises a substrate, such as printed circuit board material, on which an array of finger electrodes (not shown) are disposed, the finger electrodes being spaced apart along the longitudinal axis direction. A progressive range of voltages can be applied along lengths of the auxiliary electrodes by implementing a voltage divider that utilizes static resisters interconnecting individual finger electrodes of the arrays. The voltages applied to the finger electrodes create an axial electric field within the chamber 53 that is parallel to the longitudinal axis and that assists in pulling fragment ions through the gas within the chamber and towards an outlet aperture 6 that is disposed at an ion outlet end of the collision cell 34*a*. In FIG. 2, a projection of the gas-flow-restricting inlet and outlet apertures 6, which are assumed to have identical diameters, onto the cross-sectional plane of the drawing is shown in phantom.

Collision cells require an internal pressure of collision gas that is high enough to fragment and ultimately collisionally damp ion kinetic energy. This process becomes increasingly difficult with increasing m/z values of precursor ions, since those ions lose less energy in each collision and are often introduced into the collision cell with deliberately greater kinetic energy than is used for ion species having lower m/z values. As schematically depicted in FIG. 7, collision gas from through inlet tube 35 is introduced into the chamber 53 through a gas inlet aperture 9 that is located approximately midway between the two ends of the collision cell. The gas escapes through front-end and rear-end apertures 6 which, respectively, receive the precursor ions into the collision cell from an upstream component and deliver product ions out to a mass analyzer.

Collision cell pressures are typically maintained within a range 1-20 mTorr, which may be one-thousand times greater than the optimal operating pressures of other mass spectrometer components, such as mass filters and mass analyzers, that are both upstream and downstream from the collision cell. Thus, the front-end and rear-end apertures 6 of the collision cell must be small in diameter, since any collision gas that that is able to escape through the apertures and subsequently enter the other mass spectrometer components (e.g., mass analyzers, ion traps, etc.) has a very detrimental effect on ion transmission. However, there is a practical lower limit to the size of these apertures. Therefore, there is a need in the mass spectrometry art for collision cell designs that are able to attain the highest possible internal pressure possible while, at the same time, reducing the flow rate of collision gas to the collision cell, thereby reducing the burden of vacuum pumps and minimizing the amount of collision gas that is able to escape to other mass spectrometer components.

SUMMARY

The inventors herein present strategies for choosing geometries of collision-induced-fragmentation cells ("collision cells"), ion cooling cells, and other ion/gas reaction cells which, for a given flow rate of gas, advantageously yield internal gas pressures that are greater than the internal gas pressures that are developed within conventional collision and ion cooling cells. The achievable greater pressures may be employed for enhanced and/or better controlled ion fragmentation during tandem mass spectrometry measurements. The novel strategies disclosed herein are based on the non-intuitive nature of how molecules move within structures under molecular flow.

According to a first aspect of the present teachings, a mass spectrometer collision cell system there is provided, the system comprising:

- a gas containment vessel comprising an internal chamber having an ion inlet end and an ion outlet end, the chamber having a cross-sectional area, $A_{chamber}$, transverse to the longitudinal axis;
- a gas inlet aperture for providing gas to the internal chamber;
- first and second gas outlet apertures disposed at or proximal to the ion inlet and ion outlet ends of the internal chamber, respectively, the first and second gas outlet apertures having respective outlet aperture cross-sectional areas, $A_{aperture1}$ and $A_{aperture2}$, and an average outlet aperture cross-sectional area, $A_{aperture}^{ave}$;
- a longitudinal axis of the chamber extending from the ion inlet end to the ion outlet end and having a length, $L_{chamber}$; and
- a set of multipole rod electrodes, wherein at least a portion of each multipole rod electrode is disposed within the chamber,
- wherein the values of $A_{chamber}$, $L_{chamber}$ and $A_{aperture}^{ave}$ are such that the combined gas conductance of the chamber and the gas outlet apertures is less than or equal to 95 percent of the gas conductance of the gas outlet apertures alone.

Preferably, the values of $A_{chamber}$, $L_{chamber}$ and $A_{aperture}^{ave}$ are such that the combined gas conductance of the chamber and the gas outlet apertures is less than or equal to 90 percent, 80 percent or 70 percent of the gas conductance of the gas outlet apertures alone.

According to a second aspect of the present teachings, a method of mass analyzing a sample is provided, the method comprising:

- generating a first plurality of ions derived from the sample and transmitting the plurality of ions into a chamber having an internal pressure, $P_1$;
- transmitting the first plurality of ions through a first gas-restricting aperture into a second chamber having an internal pressure, $P_2$, where $P_2>P_1$;
- either cooling the first plurality of ions within the chamber or reacting the first plurality of ions with gas in the chamber to generate a plurality of product ions;
- transmitting either the cooled first plurality of ions or the plurality of product ions through a second gas-restricting aperture into a third chamber having an internal pressure, $P_3$, where $P_2>P_3$; and
- mass analyzing either the cooled first plurality of ions or the plurality of product ions using a mass analyzer within the third chamber,
- wherein the combined gas conductance of the second chamber and the gas-restricting apertures is less than or equal to 95 percent of the gas conductance of the gas-restricting apertures alone.

Preferably, the values of $A_{chamber}$, $L_{chamber}$ and $A_{aperture}^{ave}$ are such that the combined gas conductance of the chamber and the gas outlet apertures is less than or equal to 90 percent, 80 percent or 70 percent of the gas conductance of the gas outlet apertures alone.

BRIEF DESCRIPTION OF THE DRAWINGS

The above noted and various other aspects of the present invention will become apparent from the following description which is given by way of example only and with reference to the accompanying drawings, not necessarily drawn to scale, in which.

DETAILED DESCRIPTION

Figure 1A:
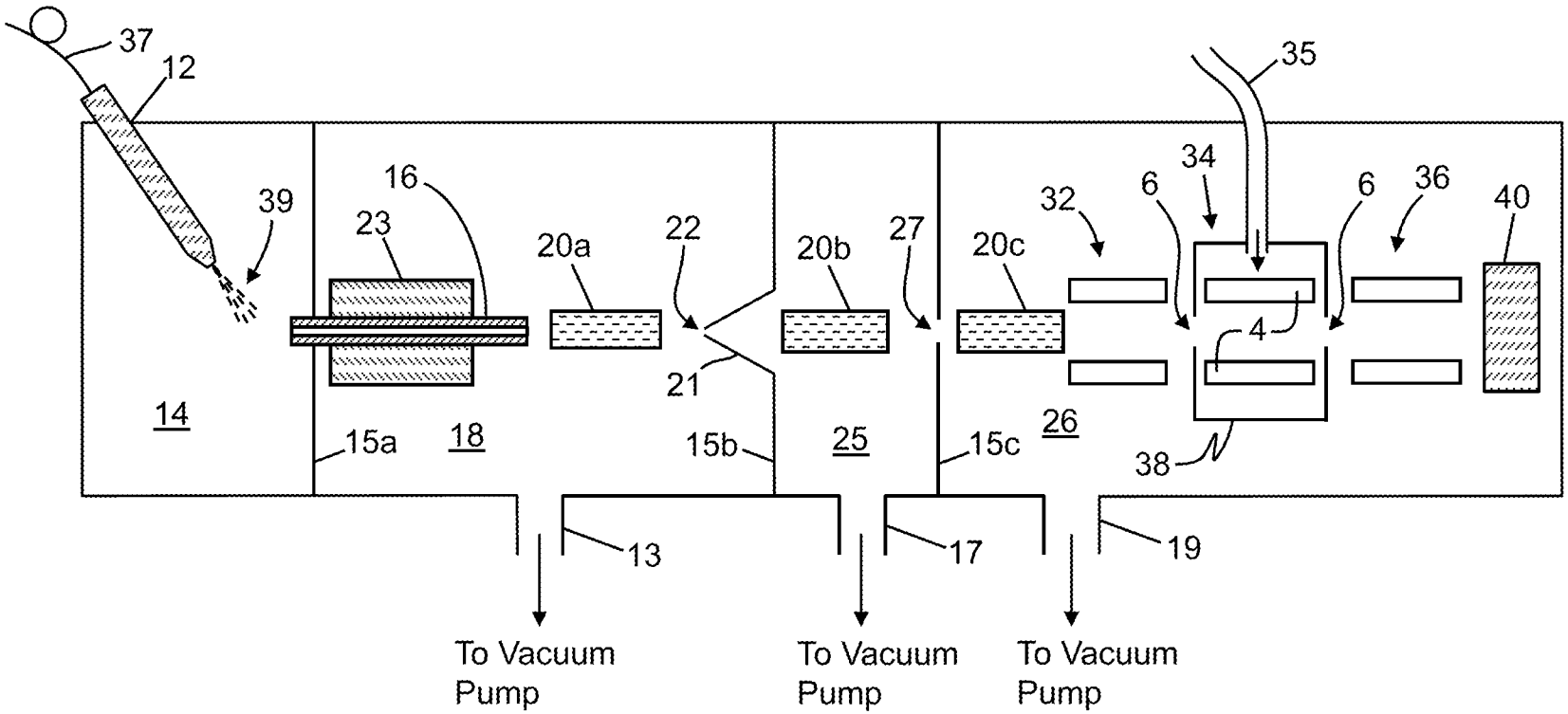
FIG. 1A is a schematic illustration of liquid chromatography and mass spectrometry (LCMS) analysis system that employs a conventional triple-quadrupole mass spectrometer system.
Figure 1B:
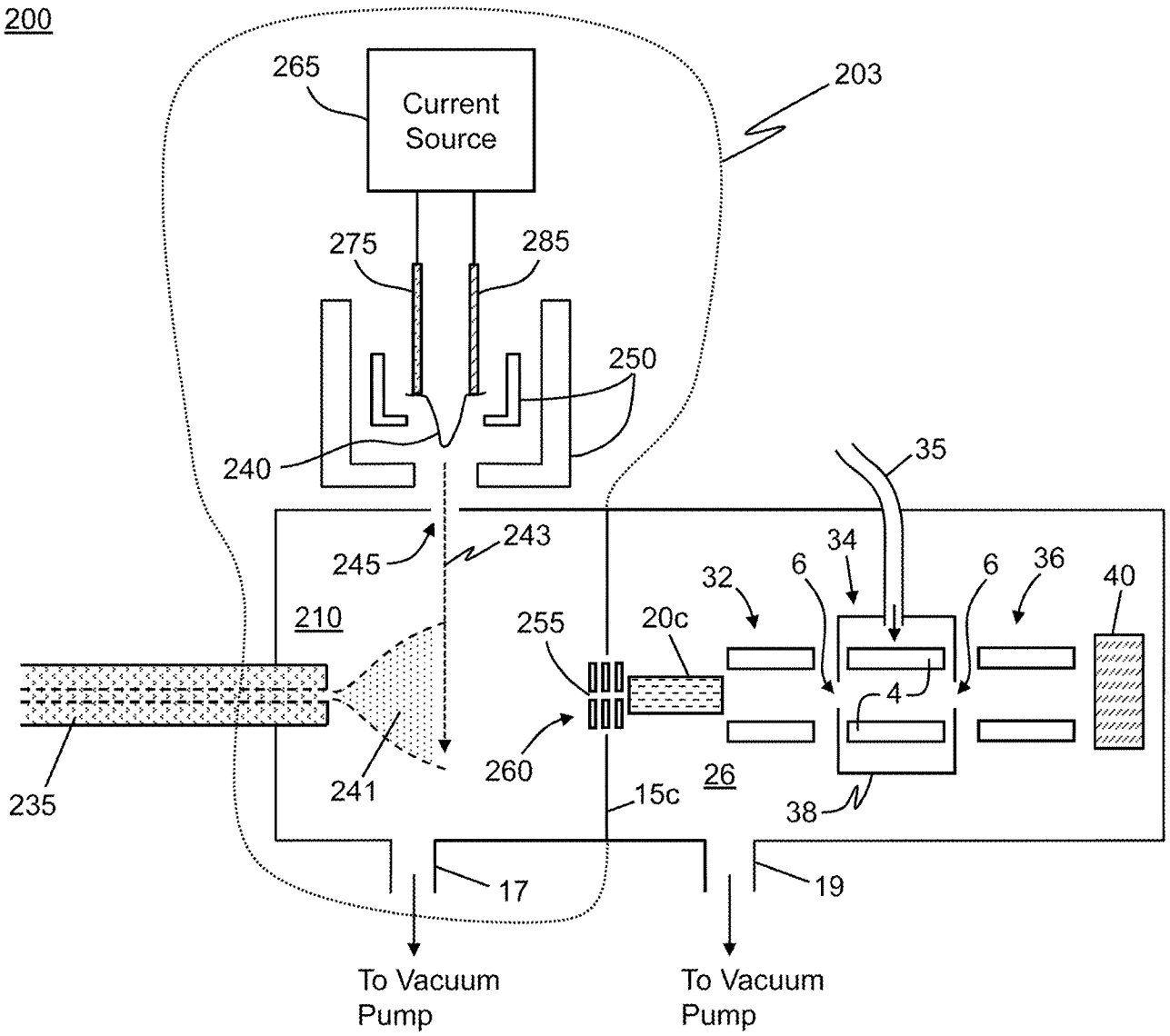
FIG. 1B is a schematic illustration of gas chromatography and mass spectrometry (GCMS) analysis system that employs a conventional triple-quadrupole mass spectrometer system.

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. To fully appreciate the features of the present invention in greater detail, please refer to FIGS. 1-7, 8A and 8B in conjunction with the following description.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that, for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of candidates or alternatives is merely illustrative, not limiting, unless implicitly or explicitly understood or stated otherwise.

The Clausing factor, K, is often used for static molecular flow calculations (Clausing, Pieter. "Ober das Kosinusgesetz der Zurückwerfung als Folge des zweiten Hauptsatzes der Thermodynamik." *Annalen der Physik* 396, no. 5 (1930): 533-566.). The Clausing Factor is a transmission probability correction factor that that ranges from zero to unity and that must be applied in order to correct calculations of gas flux through a theoretical aperture in an infinitely thin plane to real apertures of non-zero thickness, e.g., tubes of length, L. This factor takes into account the phenomenon that, when a tube has non-zero length, L, there are certain molecule trajectories that are excluded from passing out of the tube through the aperture because of angular restrictions. The original calculations of K were based on early Monte-Carlo simulations of molecular flow through tubes of different L/d ratios. Subsequently, the results of such calculations have been fit to empirical equations and tabulated. Clausing tables may also be used to gas conductance values and internal pressures for various types of tubes and chambers.

Figure 3A:
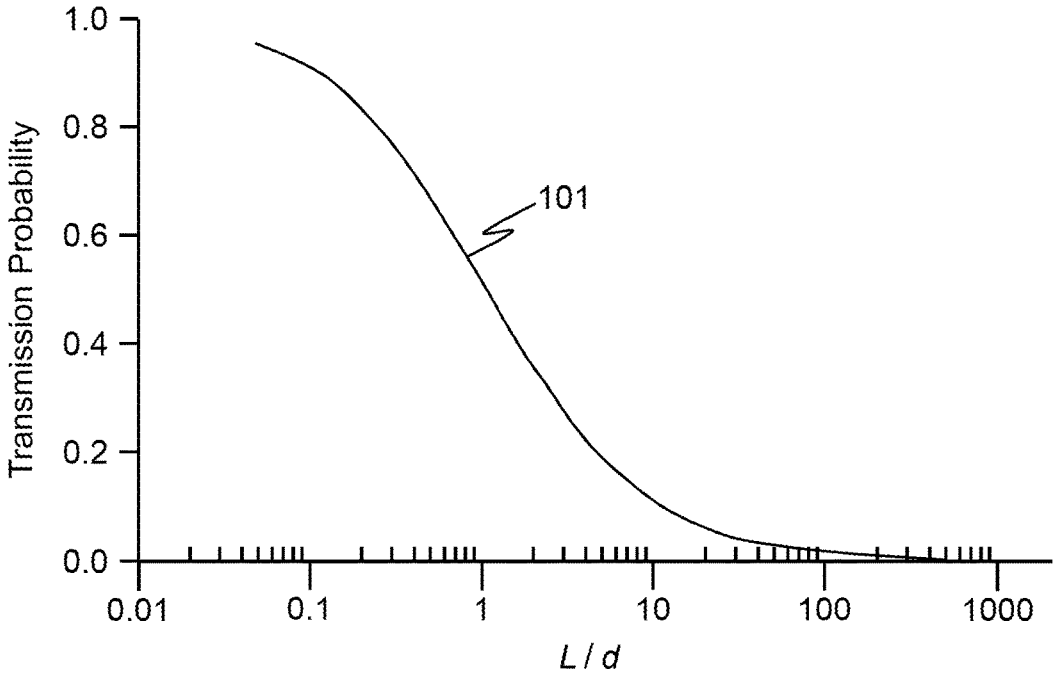
FIG. 3A is a graph of the variation of the Clausing factor, shown as the variation of the probability of transmission gas or ion particles through a tube of length, L, and diameter, d, with changing ratio, L/d.

FIG. 3A is a graph 101 of the variation of the Clausing factor, K, as calculated for a simple tube of length, L, and diameter, d, with changing ratio, L/d. It may be observed that the transmission probability drops as the L/d ratio increases; molecules are less likely to pass through a tube which has a large length-to-diameter ratio. A key phenomenon that contributes to the value of the Clausing factor is the fact that the rebound of gas molecules from internal surfaces within follows so-called Lambertian reflection, which is otherwise known as the Cosine Law.

Figure 3B:
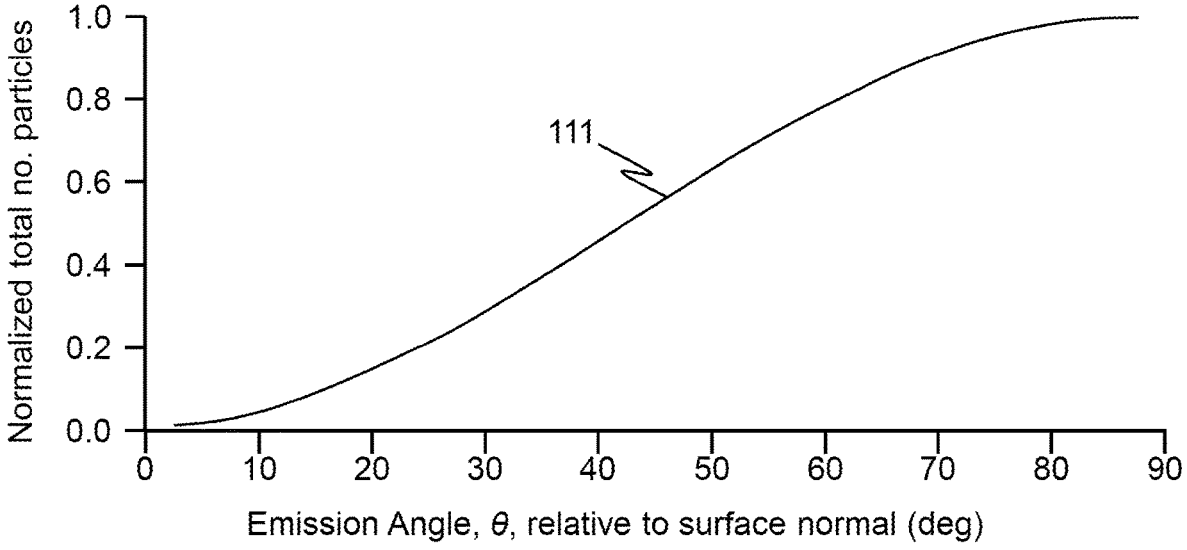
FIG. 3B is a graph of the calculated cumulative probability density of reflection or scattering of particles off of a surface as a function of the angle of emission from the surface, in accordance with Lambertian reflection.

Lambertian reflection, as referred to herein, is analogous to Lambert's cosine law in the field of optics which states that the radiant intensity or luminous intensity observed from an ideal diffusely reflecting surface or ideal diffuse radiator is directly proportional to the cosine of the angle θ between the direction of the incident light and the surface normal. When molecules interact with a surface (metal, ceramic, plastic, etc), the molecular structure is rough relative to the size of a molecule. Molecules interact with this roughness and ultimately lose "memory" of the original angle of incidence. This phenomenon leads to desorption angles which are centered around normal to the surface and to the Cosine Law. With regard to this phenomenon, Rozanov (Rozanov, L. N. "Vacuum Technique" (2002) Hablanian, M. H. ed.) notes that a particularly relevant idea that emerges from Clausing's paper is that "the molecules leaving a surface at equilibrium consist of molecules having undergone, in general, various types of interaction with the surface: elastic scattering (specular reflection, diffraction in various channels), inelastic scattering (one or multiphonon annihilation or creation) or desorption (following adsorption). If more than one of these processes are effective, the distribution of the molecules leaving the surface, as a result of one of these processes, is in principle arbitrary even at equilibrium. The only constraint imposed by the presence of equilibrium is that the sum of all the distributions must be cosine." FIG. 3B is a graph 111 of the calculated cumulative probability density of reflection or scattering of particles off of a surface as a function of the angle of emission from the surface, in accordance with Lambertian reflection.

Based on the above considerations, the present inventors have recognized that the reason why molecules are generally prevented from escaping from a tube having a large L/d ratio is that, even when using the maximum diameter openings at the ends of the tube (i.e., apertures having the same diameter as the tube diameter), the average trajectories of molecules rebounding off of the tube interior surfaces are transverse to the longitudinal axis of the tube. As a result, there are relatively few internal pathways by which molecules rebound can off of the interior surfaces and still pass through an aperture immediately after the rebound. A consequence of the Lambertian reflection phenomenon is that, for a given constant diameter, $d_{aperture}$, of gas-flow restricting apertures at the ends of a tube having length, L, and tube diameter, d, it is increasingly less likely for gas molecules to pass through the apertures as the ratio, L/d, increases (e.g., FIG. 3A). In such instances, an increase in L/d at a constant gas flow rate causes an increase in internal cell pressure.

In order to exploit the phenomenon of Lambertian reflection, the inventors have studied how changing the geometry of a collision cell affects its internal gas pressure. Three different simple empty tubes with different inner diameters were fabricated by three-dimensional printing as listed in Table 1 below. The internal gas pressure of each tube under a flow of argon gas at 300 K was determined as the inlet pressure required to create a steady-state flow of 0.248 mL/min through the respective tube. Additionally, expected internal tube pressures were calculated from Direct Simulation Monte Carlo (DSMC) calculations [e.g., see G. A. Bird, "Molecular Gas Dynamics and the Direct Simulation of Gas Flows" (Oxford University Press, Oxford, 1994)] as well as by using the Clausing factor. The results of the experiments and calculations are shown in Table 1 below.

TABLE 1

Figure 7:
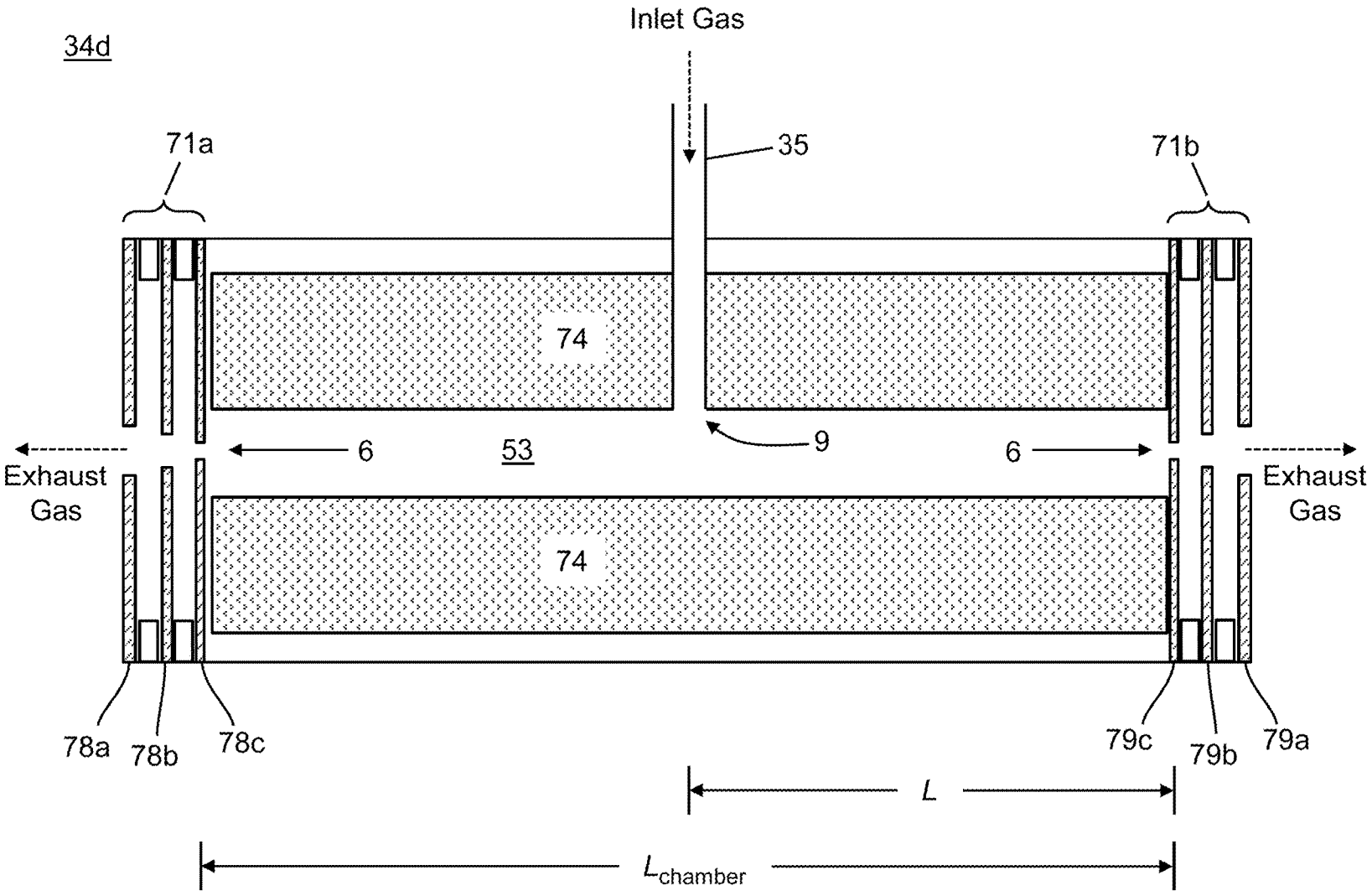
FIG. 7 is a schematic longitudinal cross-sectional diagram of a third collision cell apparatus in accordance with the present teachings.

Experimental data from 3D printed tubes. 2.5 mm apertures, 125 mm total internal chamber length, $L_{chamber}$ (see FIG. 7).

| Cell Inner Diameter (mm) | Pressure (mTorr) determined from DSMC simulation | Pressure (mTorr) determined from Clausing Factor | Pressure (mTorr) measured |
|---|---|---|---|
| 40 | 5.5 | 4.1 | 3.9 |
| 24 | 5.8 | 4.2 | 4.3 |
| 2.50 | 40.3 | 67.3 | 78.1 |

FIG. 7, which is discussed further in a subsequent paragraph, shows how the length, L, of the calculations and measurements of pressure in simple tubes relate to dimensions of a mass spectrometer collision cell, ion/gas reaction cell or cooling cell. Each simple tube comprises an inlet aperture and an outlet aperture that are at opposite ends of the tube. The inlet and outlet apertures of a simple tube are thus spaced apart by a distance, L, where L is just the length of the tube in question. However, in the mass spectrometer collision cell, ion/gas reaction cell or cooling cell, gas does not enter into the cell interior at one of the ends of the cell. Instead, gas is introduced into the cell interior chamber 53 of the cell through an ion inlet aperture 9 that is disposed approximately mid-way between the two end apertures 6. Each of the two end apertures 6 is a gas outlet end, even though one of the end apertures is an ion inlet end and the other end aperture is an ion outlet end. Thus, the effective cell length, L, that must be used for comparison to theoretical pressure calculations and simulations and for comparison to pressure measurements in simple tubes is one-half of the length, $L_{chamber}$, of the cell interior chamber 53 as shown.

As stated in the Background section of this document, the inventors have identified a need in the mass spectrometry art for collision cell designs that are able to attain the highest possible internal pressure possible while, at the same time, reducing the flow rate of collision gas to the collision cell. The ratio of gas flow rate to pressure is known as conductance, which may be stated in units of liters per second as follows:

$$\text{Conductance}\left[\frac{L}{s}\right] = 12.67 \times \frac{\text{Flow Rate}\left[\text{atm}\frac{\text{mL}}{\text{min}}\right]}{\text{Pressure}\,[mTorr]}$$

Thus, the above-identified need in the art may be satisfied by making cell conductance as small as possible. As a result of the observed close correspondence between measured pressures and pressures that are calculated using the Clausing factor (Table 1), it is possible to predict the internal pressures will be developed, under steady-state gas flow, in tube-like collision cells of other sizes and then calculate the conductance. More generally, it is possible to measure conductance for any tentative collision cell design. It is then possible to calculate a quantity which is herein referred to as "relative conductance", which is the ratio of the conductance for a complete collision cell system (including the interior chamber and the its gas inlet and gas outlet apertures) to the theoretical conductance of the apertures by themselves. The theoretical gas conductance, $C_{aperture}$, of an aperture (or "theoretical aperture conductance") is herein defined as the limiting conductance of a circular-bore tube of inner diameter, d, as tube length, L, approaches zero. Generally, for any tube of finite length, $C_{tube}=\nu\kappa_{tube}A_{tube}/4$, where $\nu$ is the average molecular velocity, $\kappa_{tube}$ is the Clausing factor of the tube and $A_{tube\ is}$ the cross-sectional area of the tube. Similarly, $C_{aperture}=\nu\kappa_{aperture}A_{aperture}/4$ where $\kappa_{aperture}$ and $A_{aperture}$ are the Clausing factor and cross-sectional area of the aperture, respectively. The above procedure gives a ratio of how much lower the conductance of the complete collision cell geometry is compared to the conductance of the apertures in isolation. This procedure also normalizes out the molecular velocity and temperature of the gas.

Figure 4A:
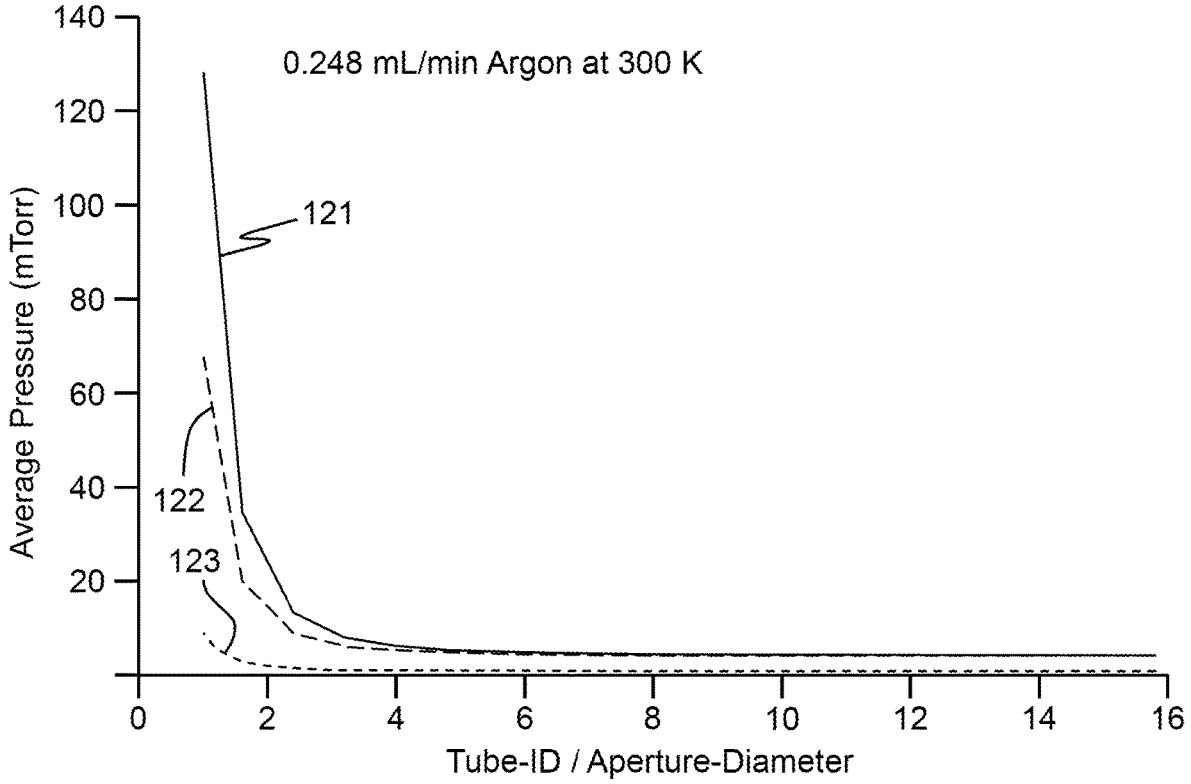
FIG. 4A is a graph with a set of graphical plots, each plot representing a different collision cell tube length, of calculated average pressure in the collision cell at various ratios of tube diameter to aperture diameter, the values of each plot calculated for a steady-state flow of 0.248 mL/min of Argon gas at 300 K.

For example, FIG. 4A is a graph of the calculated pressure within simple tubes having various lengths, inner diameters and inlet and outlet aperture diameters. The values of each plot of FIG. 4A are calculated for a steady-state flow of 0.248 mL/min of Argon gas at 300 K. Plot 121 of FIG. 4A pertains to a series of tubes having inner diameters ranging from 39.5 mm to 2.5 mm, all tubes 250 mm long and positioned adjacent to an outlet aperture having a 2.5 mm aperture diameter. Plot 122 pertains to a series of tubes having inner diameters ranging from 39.5 mm to 2.5 mm, all tubes 125 mm long and positioned adjacent to an outlet aperture having a 2.5 mm aperture diameter. Plot 123 pertains to a series of tubes having inner diameters ranging from 79.0 mm to 5.0 mm, all tubes 125 mm long and positioned adjacent to an outlet aperture having a 5.0 mm aperture diameter.

Figure 4B:
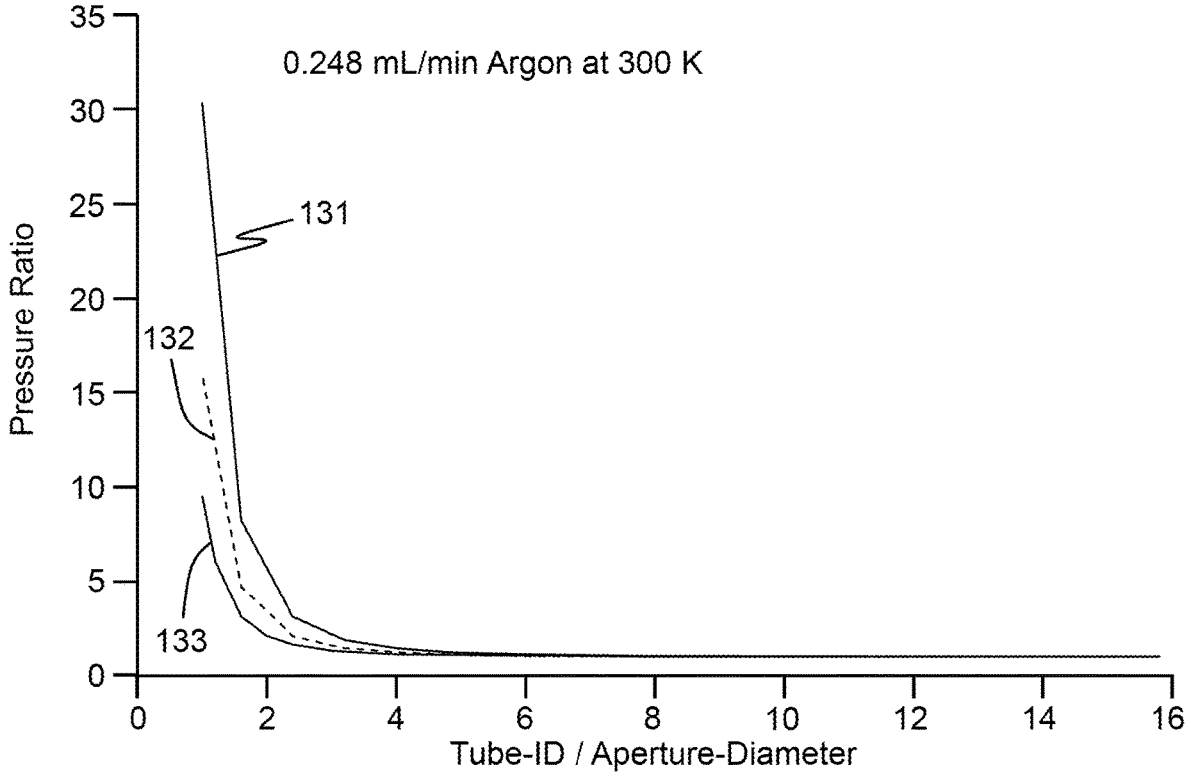
FIG. 4B is a set of graphical plots of the same collision cell internal pressure information plotted in FIG. 4A, but with the ordinate showing the ratio of calculated pressure to the asymptotic minimum possible pressure.

The asymptotic values (i.e., baseline values) of pressure that are approached at the right-hand side of the graph of FIG. 4A represent the pressures that are developed in a collision cell within which the conductance is determined only by the diameter of the inlet and outlet apertures. In FIG. 4B, the data of FIG. 4A is migrated to a common baseline. Thus, the plots 131, 132 and 133 represent the same data as graphed in plots 121, 122 and 123, respectively and represent the ratio of the calculated pressures in each tube cell to the respective baseline value. In many instances, the length, L, of the collision cell and the diameter, $d_{aperture}$, are not free to vary as a result of external constraints. The plots of FIG. 4B demonstrate that, under conditions where the aperture diameter is constrained, an advantageous gain in pressure can be achieved at constant gas flow rate by reducing the tube diameter and thereby reducing the conductance of the apparatus.

Figure 2:
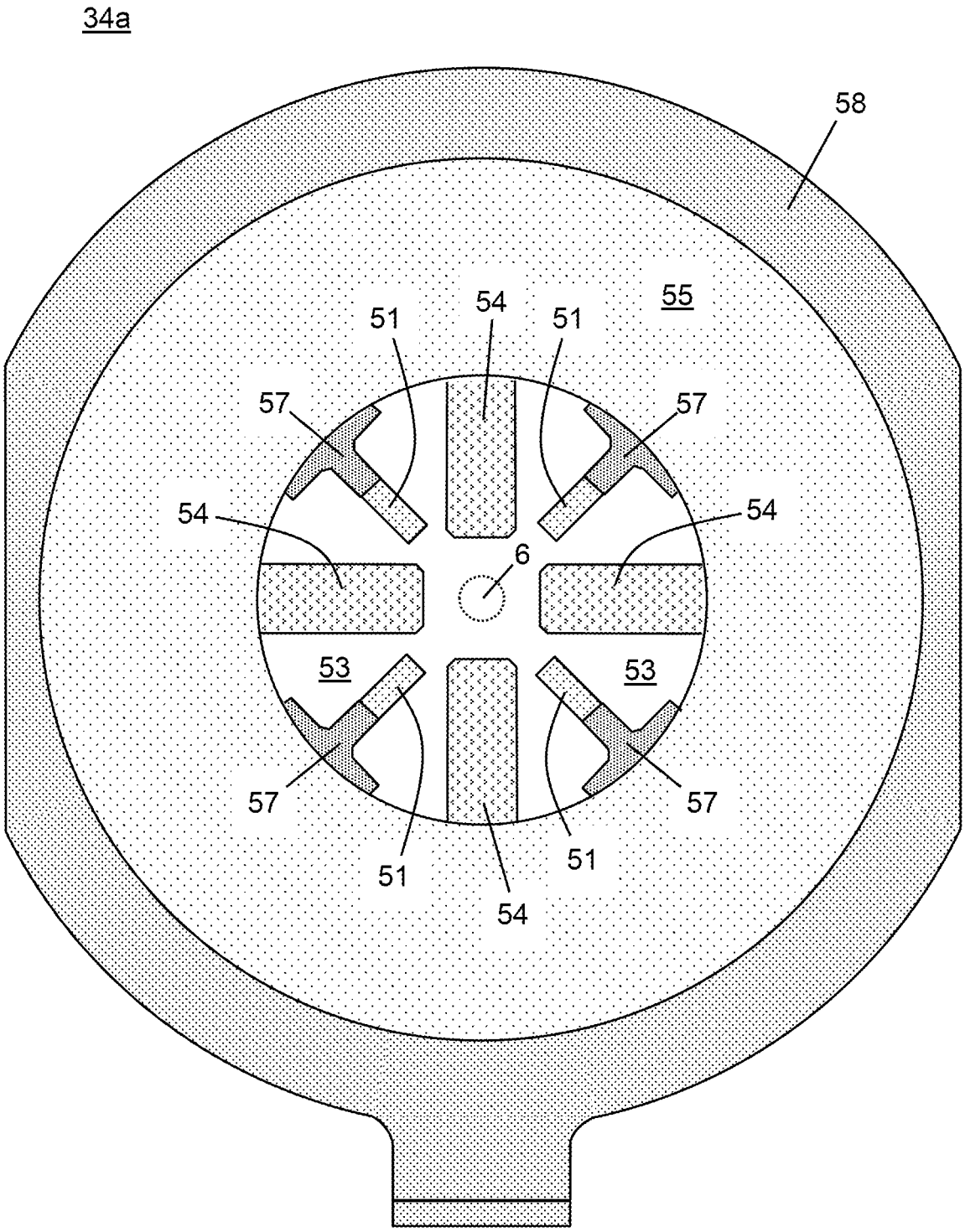
FIG. 2 is a schematic transverse cross-sectional diagram of a known collision cell apparatus.
Figure 5A:
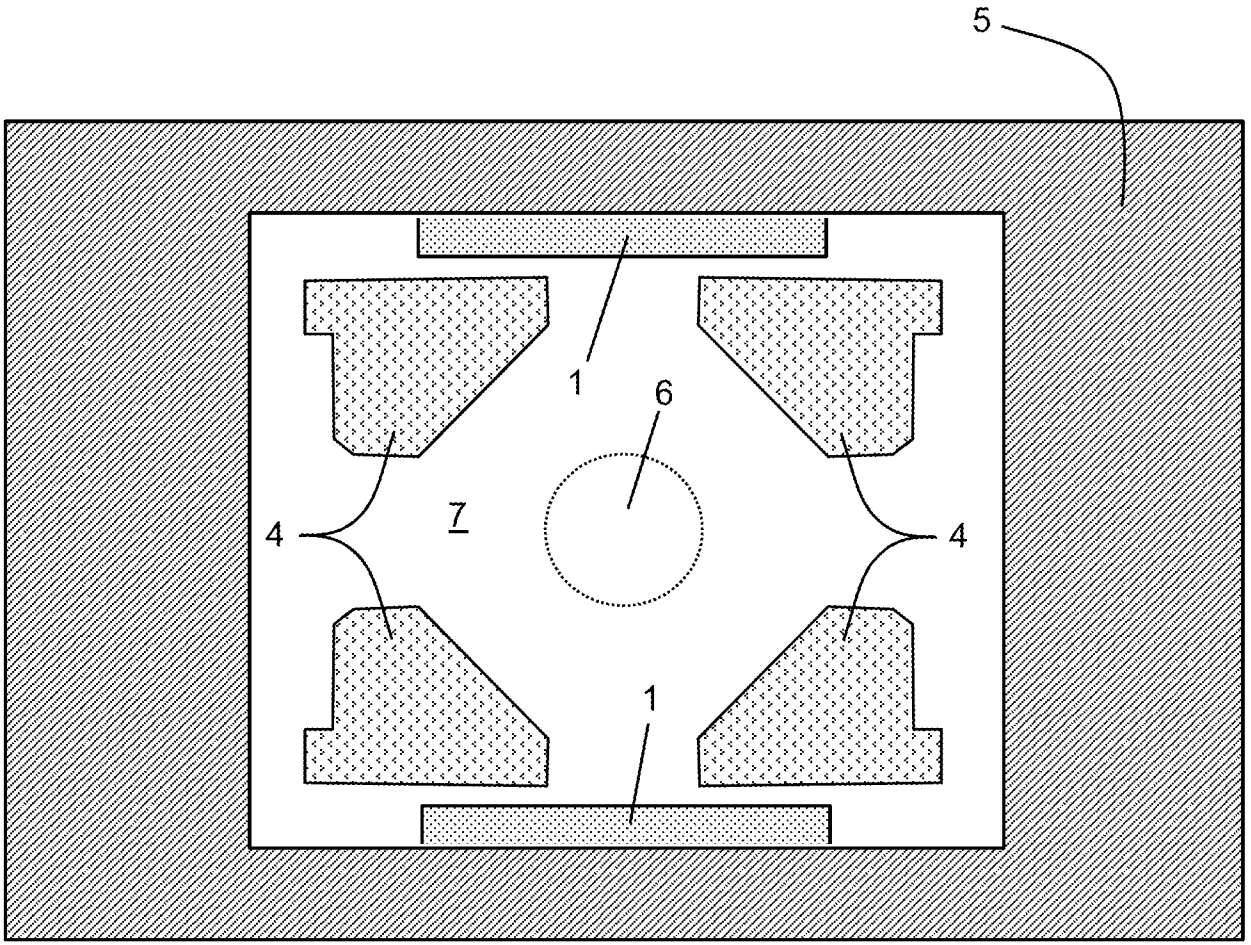
FIG. 5A is a schematic transverse cross-sectional diagram of a first collision cell apparatus in accordance with the present teachings.
Figure 5B:
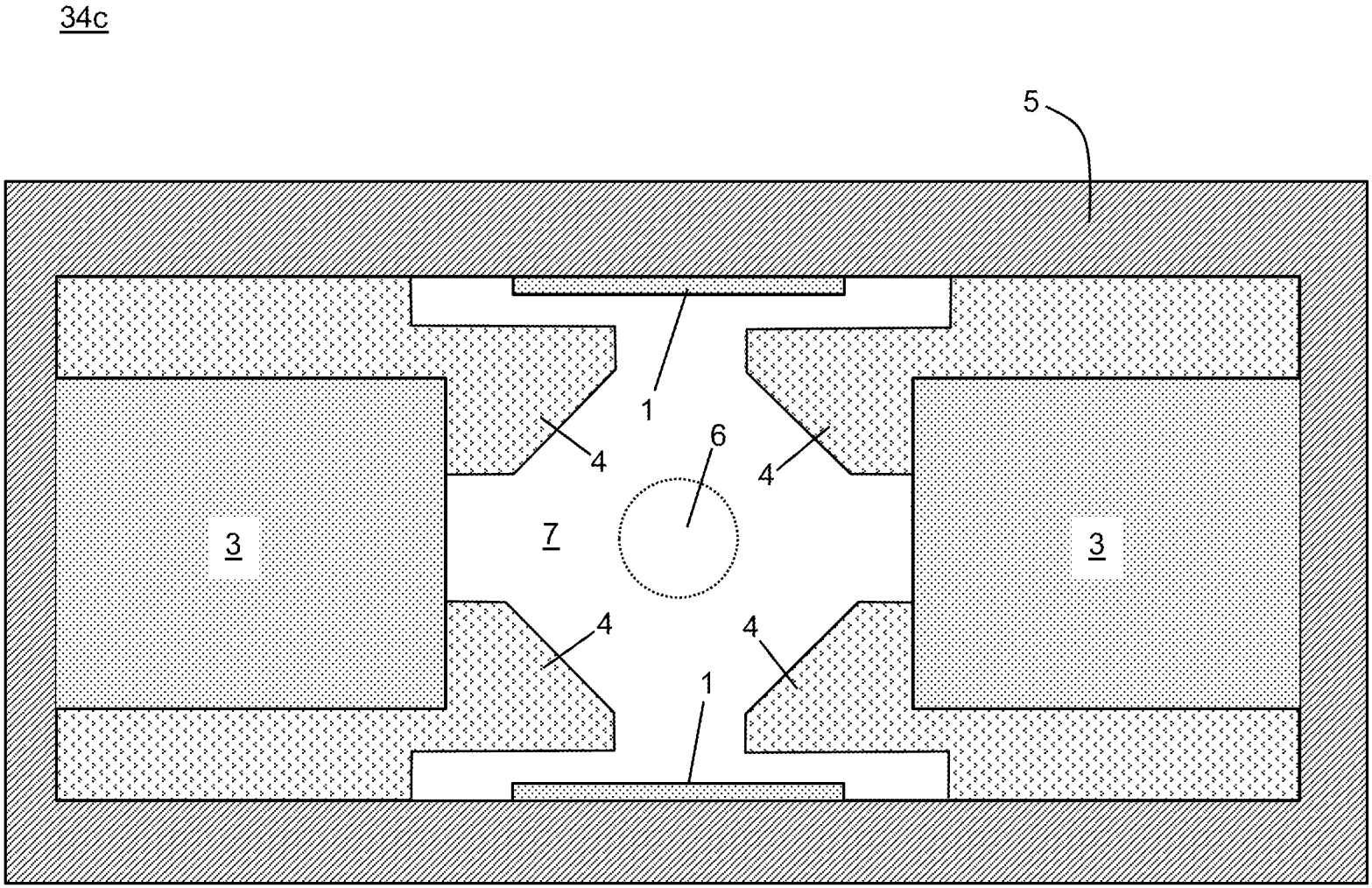
FIG. 5B is a schematic transverse cross-sectional diagram of a second collision cell apparatus in accordance with the present teachings.

In order to take advantage of the above insights, the inventors have developed new collision cell designs that can achieve higher internal pressures than can be achieved within conventional collision cells without an increase in gas flow relative to conventional designs. Accordingly, each of FIG. 5A and FIG. 5B is a schematic transverse cross-sectional diagram of a collision cell, cooling cell or reaction cell apparatus 34*b*, 34*c* in accordance with the present teachings. The cross sections shown in FIGS. 5A-5B are taken transverse to a longitudinal axis of the respective apparatus. In similarity to the collision cell 34*a* depicted in FIG. 2, each of the apparatuses 34*b*, 34*c* comprises a set of four quadrupole rods 4 that are elongated parallel to the longitudinal axis of the respective apparatus 34*b*, 34*c*. Within each apparatus, the quadrupole rods are disposed within a central chamber 7 of a housing structure 5. Gas is provided into the chambers 7 through a gas inlet tube 35 (see FIGS. 1A, 1B) that is not depicted in FIGS. 5A-5B but that passes through the housing 5 within a transverse cross section other than the cross sections shown in FIGS. 5A-5B. In each of FIGS. 5A-5B, the outlet aperture 6 is shown as a projection onto the plane of the drawing. An axial field may be generated within each cell 34*b*, 34*c* by means of pluralities of electrodes printed onto each of the circuit boards 1. Each of the collision, cooling or reaction cell apparatuses 34*b*, 34*c* that are depicted in FIGS. 5A-5B employs a modified design in which the ratio between the cross-sectional area of the central chamber 7 and the cross-sectional area of the aperture 6 is greatly reduced relative to the similarly calculated ratio for the conventional cell 34*a* (FIG. 2). Specifically, the ratio of chamber cross-sectional area to aperture cross-sectional area of the conventional cell 34*a* is approximately 103 but the similarly calculated ratios of the novel cells 34*b* and 34*c* are approximately 22 and 9, respectively.

Figure 6:
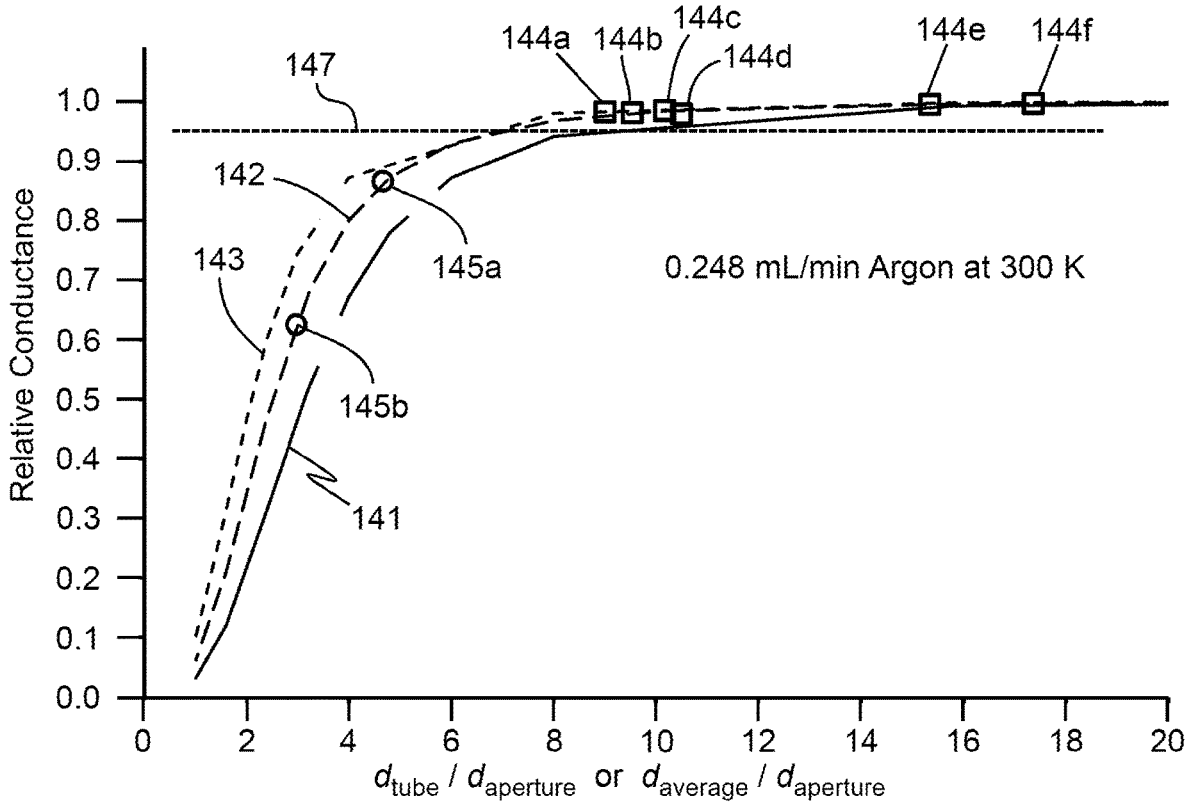
FIG. 6 is a graph with a set of graphical plots, each plot representing a collision cell tube length, of calculated gas conductance through the collision cell at various ratios of tube diameter to aperture diameter, the values of each plot calculated for a steady-state flow of 0.248 mL/min of Argon gas at 300 K, the graph also showing gas conductance values of six known conventional collision cells and the gas conductance values of the novel collision cells depicted in FIGS. 5A and 5B.

FIG. 6 is a graph that compares measured relative gas conductance values of several commercially-available collision-induced dissociation cells to the measured conductance of the novel collision-induced dissociation cell shown in FIG. 5A. All data shown in FIG. 6 were obtained using a gas flow rate of 0.248 mL/min of argon at 300 K. The relative conductance values are plotted against ordinate values determined as the ratio of an average inner diameter, $d_{average}$, of an internal chamber of a collision cell to the diameter, $d_{aperture}$, of the bounding gas-constricting apertures. For purposes of comparison between two different physical collision cell structures, the quantity $d_{average}$ should be calculated consistently. In simple cases, the cross section of the internal chamber may be circular, in similarity to the cross section depicted in FIG. 2, with diameter, $d_{tube}$. In such cases, $$d_{average}=d_{tube}.$$

Otherwise, if the cross section is a rectangle with height, h and width, w, then one may approximate $d_{average}$ as $$d_{average} = 2\sqrt{\frac{hw}{\pi}}.$$

If the tube or chamber in question is long and narrow, then, instead of estimating relative conductance values by comparing diameters or cross-sectional areas (as above), it is preferable to calculate the conductance directly using rectangular duct Clausing factors or DSMC calculations.

The Clausing factor for a rectangular duct can be calculated using the tables in Santeler, D. J.; Boeckmann, M. D. "Molecular Flow Transmission Probabilities of Rectangular Tubes", Journal of Vacuum Science Technology A, 1991, 9(4), 2378-2383. The conductance of the rectangular chamber is then calculated as $$C_{chamber}=(\nu\kappa_{chamber}A_{chamber})/4$$

where $A_{chamber}$=hw is the cross-sectional area of the rectangular chamber and $k_{chamber}$ is the Clausing factor of the rectangular chamber.

For tubes or chambers having more complex cross-sectional shapes, one may compare different chamber designs or to compare estimated chamber conductance to aperture conductance by comparing cross sectional areas instead of comparing average diameters. For example, one may determine the cross sectional area, $A_{chamber}$, of the chamber by graphical integration and then compare $A_{chamber}$ to $A_{aperture}$ (where, in general, $A_{aperture}=\pi r_{aperture}^2$) or else compare $A'_{chamber}$, relating to the cross sectional area of a first collision cell structure, to $A''_{chamber}$ relating to a the cross sectional area of a second collision cell structure to which the first cell structure is being compared.

Plotted point 144*c* on FIG. 6 pertains to the instance of the cell design shown in FIG. 2. Plotted point 145*a* pertains to the novel cell design shown in FIG. 5A. Plotted point 145*b* pertains to the novel cell design shown in FIG. 5B. Plotted points 144*a*, 144*b*, 144*d*, 144*e*, and 144*f* pertain to other known cell designs. For comparison, curves 141, 142 and 143 depict calculated relative conductance values of various tube and aperture combinations. The abscissa value of each plotted point of FIG. 6—either on one of the curves 141-143 or plotted individually—represents a ratio between the conductance of an elongated internal volume relative to the theoretical aperture conductance of just the bounding apertures that are adjacent to the ends of the elongated internal volume. As noted above, the theoretical conductance of an aperture (or "theoretical aperture conductance) is herein defined as the limiting conductance of a circular-bore tube of inner diameter, d, as tube length, L, approaches zero. Curve 141 pertains to a circular-bore tube having a length, L, of 250 mm and variable inner diameter, $d_{tube}$, together with a bounding aperture having a diameter of 2.5 mm. Curve 142 pertains to a circular-bore tube having a length, L, of 125 mm and variable inner diameter, $d_{tube}$, together with a bounding aperture having a diameter of 5.0 mm. Curve 143 pertains to a circular-bore tube having a length, L, of 125 mm and variable inner diameter, $d_{tube}$, together with a bounding aperture having a diameter of 2.5 mm.

The data depicted in FIG. 6 highlights the somewhat counterintuitive fact that, in all cases in which the collision cell gas chamber diameter—either $d_{tube}$ for chambers having circular cross sections or $d_{average}$ otherwise—is greater than the aperture diameter, $d_{aperture}$, the gas conductance of the collision cell decreases as the diameter of the collision cell chamber decreases. When the collision cell diameter is much greater than the diameter of the surrounding gas-restricting apertures (i.e., greater by a factor of 7 or more (see FIG. 6), the gas conductance of the collision cell system (i.e., collision cell and apertures) is predominantly controlled by the diameter of the apertures. However, as the collision cell diameter decreases, the Clausing factor of the chamber exerts an increasing level of influence over the conductance value of the system, since the collision cell has non-trivial length, L. Therefore, the conductance of the collision cell system decreases—and, correspondingly, the constant-flow-rate pressure increases—as the collision cell diameter decreases down to the diameter of the apertures. Therefore, for a given flow rate, the internal pressure increases as the collision cell diameter decreases down to the size of the bounding apertures.

As a specific example of how a decrease in collision gas chamber diameter increases internal pressure, the inventors have compared the known collision cell 34*a* of FIG. 2 (represented by point 144*c* in FIG. 6) with the novel collision, cooling or reaction cell 34*c* of FIG. 5B (represented by point 145*b* of FIG. 6). Using identical cell lengths, aperture diameters and gas flow rates, it is found that the average pressure within the interior chamber 7 of the apparatus 34*c* (FIG. 5B) is 6.7 mTorr as compared to a pressure of 4.2 mTorr within the internal chamber 53 of the collision cell 34*a* (FIG. 2). This sixty percent increase in pressure is attributable, at least in part, to the smaller ratio, in cell 34*c* as compared to cell 34*a*, between the cross-sectional area, $A_{chamber}$, of the respective internal chamber (i.e., of chamber 7 as shown in FIG. 5B as compared to chamber 53 as shown in FIG. 2) and the area, $A_{aperture}$, of the respective gas outlet apertures 6. For instance, the ratio of the cross-sectional area of chamber 53 to the cross-sectional area of outlet aperture 6 is approximately 103 for the apparatus 34*a* (FIG. 2) whereas the ratio between the ratio of the cross-sectional area of chamber 7 to the cross-sectional area of outlet aperture 6 is approximately 8.9 for the apparatus 34*c* (FIG. 5B). It should also be noted, from comparison of curve 142 (length, L, equal to 125 mm) with 141 (length, L, equal to 250 mm), the collision cell pressure could be significantly further increased, with the same cell and aperture diameters, by increasing (e.g. doubling) the length of the collision cell. Increasing the length decreases the Clausing factor of the chamber which therefore decreases the conductance and increases the pressure.

As another specific example of how a decrease in collision gas chamber diameter increases internal pressure, the inventors have compared the known collision cell 34*a* of FIG. 2 (represented by point 144*c* in FIG. 6) with the novel collision, cooling or reaction cell 34*b* of FIG. 5A (represented by point 145*a* of FIG. 6). Using identical cell lengths, aperture diameters and gas flow rates, it is found that the average pressure within the interior chamber 7 of the apparatus 34*b* (FIG. 5A) is 4.8 mTorr as compared to a pressure of 4.2 mTorr within the internal chamber 53 of the collision cell 34*a* (FIG. 2). This fourteen percent increase in pressure is attributable, at least in part, to the smaller ratio, in cell 34*b* as compared to cell 34*a*, between the cross-sectional area, $A_{chamber}$, of the respective internal chamber (i.e., of chamber 7 as shown in FIG. 5A as compared to chamber 53 as shown in FIG. 2) and the area, $A_{aperture}$, of the respective gas outlet apertures 6. For instance, the ratio of the cross-sectional area of chamber 53 to the cross-sectional area of outlet aperture 6 is approximately 103 for the apparatus 34*a* (FIG. 2) whereas the ratio between the ratio of the cross-sectional area of chamber 7 to the cross-sectional area of outlet aperture 6 is approximately 22 for the apparatus 34*b* (FIG. 5A). It should also be noted, from comparison of curve 142 (length, L, equal to 125 mm) with 141 (length, L, equal to 250 mm), the collision cell pressure could be significantly further increased, with the same cell and aperture diameters, by increasing (e.g. doubling) the length of the collision cell. Increasing the length decreases the Clausing factor of the chamber which therefore decreases the conductance and increases the pressure.

Line 147 of FIG. 6 represents a five percent decrease in collision cell system conductance, relative to the conductance of just the gas-restricting apertures of the system. Such a reduction in conductance would correspond to an approximate five percent increase in internal collision cell pressure, at constant gas flow rate. However, according to the available data, none of the known collision cell designs achieves this level of reduction of conductance, relative to the conductance of the apertures. However, the novel collision cell design of the apparatus 34*c* shown in FIG. 5B achieves an approximate 35-37 percent reduction in relative conductance, which corresponds to an approximate 56-58 percent increase in collision cell pressure, at constant flow rate. Stated differently, the value of the gas conductance of the apparatus 34*c* is approximately 63-65 percent of the value of the gas conductance of the apparatus 34*a*, yielding a constant-flow-rate pressure, in the apparatus 34*c*, that is approximately 1.55-1.59 times the pressure that is developed within the apparatus 34*a*, at the same gas flow rate. The results of FIG. 6 suggest that, in order to achieve a five percent decrease in relative conductance, the known collision cell systems would need to be modified by either decreasing the circular cross-section diameter, $d_{chamber}$, by an amount such that the ratio $d_{chamber}/d_{aperture} \leq 7$ or by increasing (e.g. doubling) the length, L, of the collision cell or by some combination of decreasing $d_{chamber}$ and increasing L.

The total conductance of gas flowing out of a collision cell involves gas flow from the gas inlet 9, 35 at the center (FIGS. 1 and 7), through a "half-tube" of length, L, that is one-half of the total length, $L_{chamber}$ of the cell (e.g., see FIG. 7), and through the aperture 6. This half-tube conductance must be multiplied by 2 since there are two parallel paths out of the chamber, one towards the entrance aperture and one towards the exit aperture. Thus, the conductance of the cell, $C_{cell}$, can be approximated as:

$$C_{cell} = \frac{2}{\frac{1}{C_{aperture}} + \frac{1}{C_{halftube}}}.$$

where $C_{aperture}$ is the conductance of each aperture and $C_{halftube}$ is the conductance from the center of the tube at the gas inlet to the aperture. Equations in Haefer, R. A.; Vacuum 1980 30 217, p. 217 and p. 221 can be used to sum more complex structures. For a large cross section tube, $C_{halftube}$ becomes very large compared to $C_{aperture}$ and the above equation reduces simply to $C_{cell}=2C_{aperture}$. However, as the cross section of the tube becomes smaller and/or the chamber length becomes longer, the resulting conductance $C_{halftube}$ decreases. A smaller cross section reduces the area and a longer distance reduces the Clausing factor. These trends lead to the inequality $C_{cell}<2C_{aperture}$ which results in the desired higher pressure for a given flow of gas.

As an example, if we have 2.5 mm diameter apertures in plates that are 0.75 mm thick, the conductance out of each such aperture will be 0.377 L/s for argon at 300 K. For a large inner diameter tube, there is no significant obstruction to the flow of gas. Therefore, in this instance, the conductance of the cell is approximately equal to $2C_{aperture}=0.76$ L/s. With a 125 mm total cell length, the conductance of the half tube drops as the inner diameter is reduced. Once the inner diameter is reduced to approximately 40 mm, the conductance of the tube itself becomes a restriction for the gas to reach the apertures. At an inner diameter of approximately 20 mm, the conductance of the cell has dropped to approximately 0.96 that of the two apertures by themselves. At an inner diameter of approximately 10 mm, the conductance of the cell has dropped to approximately 0.77 that of the two apertures by themselves. The conductance of the half-cell is 1.26 L/s. This makes the total cell conductance 0.58 L/s which is 0.77 times the conductance of the apertures by themselves, 0.76 L/s. This results in a lower conductance out of the cell. This in turn, gives a higher pressure in the cell for a given flow rate.

These equations can be used for cells which are not symmetric, in other words where the gas inlet is not at the center of the device. These equations can also be used for cells which do not have identical apertures on each end. The conductance from the gas inlet to each of the two apertures are calculated, $C_{halftube1}$ and $C_{halftube2}$. Then the conductance of the two apertures are calculated, $C_{aperture1}$ and $C_{aperture2}$. The total cell conductance is $$C_{cell}\frac{1}{\frac{1}{C_{aperture1}}+\frac{1}{C_{halftube1}}}+\frac{1}{\frac{1}{C_{aperture2}}+\frac{1}{C_{halftube2}}}.$$

For more complex geometries, DSMC can be used to calculate the total conductance of the cell. This can then be compared to the conductance of the apertures by themselves. This could include curved cells (e.g. 90°, 180°, or anything else). The conductance of cell geometries with other internal shapes which are not simply round or rectangular can be calculated by simulation. This also includes cell geometries with internal parts which make the actual conductance different from that of a simple round or rectangular tube.

FIG. 7 is a schematic longitudinal cross-sectional diagram of a third collision cell, cooling cell or reaction cell apparatus 34*d* in accordance with the present teachings. The collision, cooling or reaction cell 34*d* comprises a set of multipole rod electrodes 74 which are employed, in operation, to contain ions within an ion channel 73. Entrance lens 71*a* and exit lens 71*b* are used to control the introduction of ions into cell 34*d* and to control the flow of ions through the cell along the ion channel 73. The collision cell 34*d* differs from conventional collision cell apparatuses in that the conventional entrance end lenses are replaced by specialized einzel lenses in which the apertures of the plate electrodes composing each lens progressively decrease in size in a direction towards the cell interior. Accordingly, entrance lens 71*a* comprises the three plate electrodes 78*a*, 78*b* and 78*c*, with the outermost plate electrode 78*a* having the aperture with the greatest diameter and the innermost electrode 78*c* having the aperture with the smallest diameter. At the ion outlet end of the apparatus, the exit lens 71*b* comprises the three plate electrodes 79*a*, 79*b* and 79*c*, with the outermost plate electrode 79*a* having the aperture with the greatest diameter and the innermost electrode 79*c* having the aperture with the smallest diameter. The apertures in plates 78*c* and 79*c* are the gas-flow-restricting inlet and outlet apertures, respectively. These apertures are smaller in diameter—or, more generally, have a smaller cross-sectional area—than the apertures of conventional einzel lenses. Accordingly, the Lambertian reflection phenomenon, it is probabilistically less likely for gas molecules to pass through the apertures in plates 78*c* and 79*c* than it is for gas molecules to pass through the apertures of conventional einzel lenses, thus leading to greater internal cell pressures, assuming constant gas flow rate.

Figure 8A:
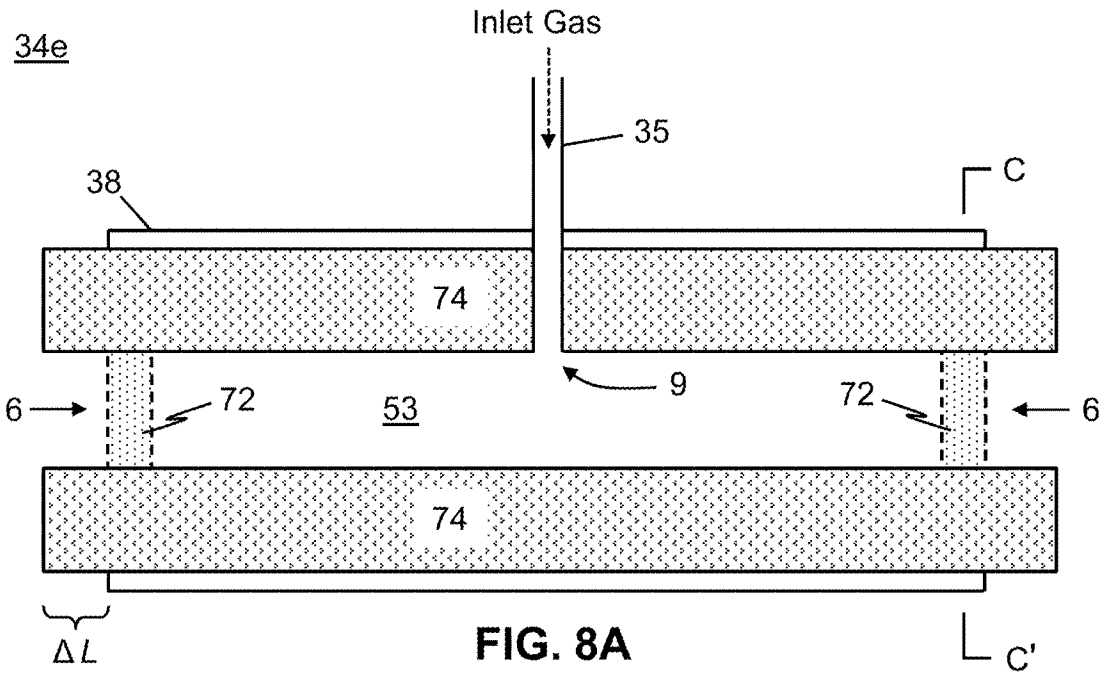
FIG. 8A is a schematic longitudinal cross-sectional diagram of a fourth collision cell apparatus in accordance with the present teachings.
Figure 8B:
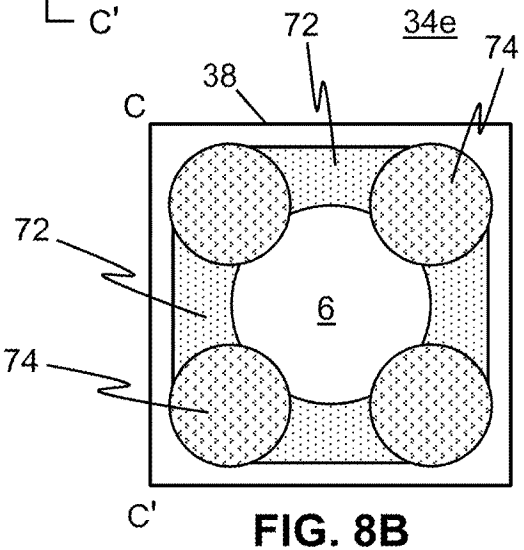
FIG. 8B is a schematic transverse cross-sectional diagram through a portion of the collision cell apparatus of FIG. 8A.

FIG. 8A is a schematic longitudinal cross-sectional diagram of a fourth collision cell, cooling cell or reaction cell apparatus 34*e* in accordance with the present teachings. FIG. 8B is a schematic transverse cross-sectional diagram of the apparatus along section C-C'. In contrast to the apparatus 34*d* that is shown in FIG. 7, the apparatus 34*e* (FIGS. 8A-8B) does not utilize end lenses. Instead, the ion focusing properties that are otherwise provided by end lenses are provided, in the apparatus 34*e*, by extensions of the multipole rod electrodes outside of the gas containment vessel 38. One such extension, of length, ΔL, is indicated in FIG. 8A. As shown in the transverse cross section of FIG. 8B, one or more insulative bodies 72, which form gas-flow barriers between pairs of rod electrodes, cause the gas flow out of each end of the gas containment vessel 38 to be limited to within a short channel 6 that functions as the gas-restricting aperture and that is centered between the rod electrode extensions. The one or more insulative bodies 72 may comprise, without limitation, either: spacers that support the rod electrodes, gaskets that are fitted between the electrodes or vacuum "feed-through" components that are affixed to the walls of the ion containment vessel.

In alternative embodiments, the portions of the internal rod electrodes that extend through the wall of the gas containment vessel 38 (FIG. 8A) may be replaced by a separate set of short "stub" electrodes (not shown) that are partially disposed outside of the containment vessel 38 and that are separated from the internal rod electrodes 74 by gaps. In such embodiments, each aperture 6 is a short channel that is centered between the stub electrodes. Each set of stub electrodes—one set at the inlet end of the apparatus 34*e* and/or or a separate set at the ion outlet end of the apparatus—comprises a separate quadrupole or multipole device. Accordingly, a power supply (not shown) is configured to provide RF voltages to the stub electrodes. The power supply may also be configured to supply DC voltage differences between the internal rod electrodes and each set of stub electrodes in order to urge ions into and out of the apparatus 34*e*.

The discussion included in this application is intended to serve as a basic description. The present invention is not intended to be limited in scope by the specific embodiments described herein, which are intended as single illustrations of individual aspects of the invention. Functionally equivalent methods and components are within the scope of the invention. As but one example, collision cells and ion cooling cells that have been used in the examples herein have been described above as having linear longitudinal axes. However, the principles described herein may also be applied more broadly to collision cells and ion cooling cells that are not straight. Thus, collision cells ion cooling cells and reaction cells that have rod electrodes that are curved along their lengths and that have curved longitudinal axes are also contemplated. Such curved multipole devices are described, for example, in U.S. Pat. Nos. 8,461,524, 9,543,136 and 6,576,897. The curvature is beneficial for the separation of uncharged molecules, which follow straight line trajectories in the absence of collisions, from ions, the trajectories of which are largely constrained to follow a pseudopotential well surrounding the curved longitudinal axis. In such instances, the chamber length, $L_{chamber}$, (which equals 2 L) should be taken as the total length of the curved longitudinal axis, from an entrance aperture to an exit aperture. Various other modifications of the invention, in addition to those shown and described herein will become apparent to those skilled in the art from the foregoing description and accompanying drawings.

What is claimed is:

1. A mass spectrometer collision cell, cooling cell or reaction cell system, comprising:

a gas containment vessel comprising an internal chamber having an ion inlet end and an ion outlet end, the chamber having a cross-sectional area, $A_{chamber}$, transverse to the longitudinal axis;

a gas inlet aperture for providing gas to the internal chamber;

first and second gas outlet apertures disposed at or proximal to the ion inlet and ion outlet ends of the internal chamber, respectively, the first and second gas outlet apertures having respective outlet aperture cross-sectional areas, $A_{aperture1}$ and $A_{aperture2}$, and an average outlet aperture cross-sectional area, $A_{aperture}^{ave}$;

a longitudinal axis of the chamber extending from the ion inlet end to the ion outlet end and having a length, $L_{chamber}$; and a set of multipole rod electrodes, wherein at least a portion of each multipole rod electrode is disposed within the chamber, wherein the values of $A_{chamber}$, $L_{chamber}$ and $A_{aperture}^{ave}$ are such that the combined gas conductance of the chamber and the gas outlet apertures is less than or equal to 95 percent of the gas conductance of the gas outlet apertures alone.

2. A mass spectrometer collision cell, cooling cell or reaction cell system as recited in claim 1, wherein the values of $A_{chamber}$, $L_{chamber}$ and $A_{aperture}^{ave}$ are such that the combined gas conductance of the chamber and the gas outlet apertures is less than or equal to 90 percent of the gas conductance of the gas outlet apertures alone.

3. A mass spectrometer collision cell, cooling cell or reaction cell system as recited in claim 1, wherein the values of $A_{chamber}$, $L_{chamber}$ and $A_{aperture}^{ave}$ are such that the combined gas conductance of the chamber and the gas outlet apertures is less than or equal to 80 percent of the gas conductance of the gas outlet apertures alone.

4. A mass spectrometer collision cell, cooling cell or reaction cell system as recited in claim 1, wherein the values of $A_{chamber}$, $L_{chamber}$ and $A_{aperture}^{ave}$ are such that the combined gas conductance of the chamber and the gas outlet apertures is less than or equal to 70 percent of the gas conductance of the gas outlet apertures alone.

5. A mass spectrometer collision cell, cooling cell or reaction cell system as recited in claim 1, wherein each of the entrance aperture and the exit aperture comprises an opening in or a channel through an electrostatic lens.

6. A mass spectrometer collision cell, cooling cell or reaction cell system as recited in claim 1, wherein each of the entrance aperture and the exit aperture is defined by a respective channel between portions of the multipole rods that extend outside of the chamber.

7. A mass spectrometer collision cell, cooling cell or reaction cell system as recited in claim 1, wherein each of the entrance aperture and the exit aperture is defined by a respective channel between rod electrodes of a respective multipole device disposed outside of the chamber.

8. A mass spectrometer collision cell, cooling cell or reaction cell system as recited in claim 1, wherein the longitudinal axis and the multipole rods are curved.

9. A mass spectrometer collision cell, cooling cell or reaction cell system as recited in claim 1, wherein $d_{aperture}$ is less than or equal to 5 millimeters.

10. A method of mass analyzing a sample comprising:

generating a first plurality of ions derived from the sample and transmitting the plurality of ions into a chamber having an internal pressure, $P_1$;

transmitting the first plurality of ions through a first gas-restricting aperture into a second chamber having an internal pressure, $P_2$, where $P_2>P_1$;

either cooling the first plurality of ions within the chamber, reacting the first plurality of ions with gas in the chamber, or colliding the first plurality of ions with gas in the chamber to generate a plurality of product ions;

transmitting either the cooled first plurality of ions or the plurality of product ions through a second gas-restricting aperture into a third chamber having an internal pressure, $P_3$, where $P_2>P_3$; and mass analyzing either the cooled first plurality of ions or the plurality of product ions using a mass analyzer within the third chamber, wherein the combined gas conductance of the second chamber and the gas-restricting apertures is less than or equal to 95 percent of the gas conductance of the gas-restricting apertures alone.

11. A method of mass analyzing a sample as recited in claim 10, wherein the combined gas conductance of the second chamber and the gas-restricting apertures is less than or equal to 90 percent of the gas conductance of the gas-restricting apertures alone.

12. A method of mass analyzing a sample as recited in claim 10, wherein the combined gas conductance of the second chamber and the gas-restricting apertures is less than or equal to 70 percent of the gas conductance of the gas-restricting apertures alone.

13. A method of mass analyzing a sample as recited in claim 10, wherein each gas-restricting aperture comprises a diameter, $d_{aperture}$, that is less than or equal to 5 millimeters.

* * * * *